US005324010A

United States Patent [19]

Ranson

[11] Patent Number: 5,324,010

[45] Date of Patent: Jun. 28, 1994

[54] STOPPER DEVICE

[75] Inventor: John Ranson, Felixstowe, England

[73] Assignee: Crane Limited, Ipswich, England

[21] Appl. No.: 36,258

[22] Filed: Mar. 24, 1993

[30] Foreign Application Priority Data

Mar. 24, 1992 [GB] United Kingdom ..... 9206394

[51] Int. Cl.[5] ..... B22D 41/18

[52] U.S. Cl. ..... 266/272; 222/602

[58] Field of Search ..... 266/272, 236; 222/602, 222/591, 590

[56] References Cited

U.S. PATENT DOCUMENTS

| | | | |
|---|---|---|---|
| 3,627,180 | 12/1971 | Montgomery | 222/602 |
| 3,848,781 | 11/1974 | Springer | 222/602 |
| 5,033,658 | 7/1991 | Thornton et al. | 222/602 |
| 5,083,689 | 1/1992 | Vaterlaus | 222/602 |
| 5,085,356 | 2/1992 | Waltenspuhl | 222/598 |

*Primary Examiner*—Scott Kastler

*Attorney, Agent, or Firm*—Dickinson, Wright, Moon, Van Dusen & Freeman

[57] ABSTRACT

A stopper device for use in molten-metal auto-pouring apparatus comprising an attachment part constructed to be releasably fixedly attached to a stopper device operator of such apparatus and a stopper support part adjustably connected to the attachment part so as to permit a degree of movement therebetween. Locking means are provided to enable the stopper support part to be retained in a given position relative to the attachment part. As a result, when the device is prepared for use, and the attachment part is fixedly attached to such an operator, the latter operates to move the device downwardly so that a lower end of a stopper mounted on the stopper support part engages the outlet of the apparatus, the said degree of movement enabling that end to be seated properly in the outlet, whereupon the locking means are used to retain the resulting position of the stopper support part relative to the attachment part to ensure that the stopper will be properly seated after subsequently being raised and lowered.

9 Claims, 2 Drawing Sheets

STOPPER DEVICE

The present invention relates to a stopper device for use in molten-metal auto-pouring apparatus.

Hitherto such a device has comprised an attachment part constructed to be fixedly attached to a stopper device .operator, and a stopper support part rigidly connected to the attachment part. The latter is so constructed as to enable the stopper device to be readily released from the operator. This is necessary because the life of such a stopper device in a foundry, in which it is in continual use, may be no greater than one day.

The disadvantage of such a stopper device is the difficulty encountered in setting it correctly so that it will properly seal an outlet of a molten-metal crucible. If the seal is not correct, molten-metal may trickle through a gap between the stopper and the outlet, and then solidify around the outlet so that the latter does not operate efficiently.

Prior to the start-up of the foundry at the beginning of the week, a relatively lengthy procedure is involved to ensure that the attachment of the stopper device to the stopper device operator correctly positions the stopper in relation to the outlet of the crucible.

Subsequently, particularly because of the very high operating temperatures within the crucible, the stopper and/or outlet may wear, or need replacement, resulting in the need for an adjustment in the positioning of the stopper in relation to the stopper device operator to maintain a proper seal. This is now particularly difficult because of the extreme temperatures at which the crucible is operated, so that the stopper device is not only less accessible, but also the substantially uniform light radiance from the stopper and the outlet render it difficult if not impossible to see the relative positioning therebetween.

The present invention seeks to provide a remedy.

Accordingly the present invention is directed to a stopper device for use in molten-metal auto-pouring apparatus comprising an attachment part constructed to be releasably fixedly attached to a stopper device operator of such apparatus and a stopper support part adjustably connected to the attachment part so as to permit a degree of movement therebetween, and locking means enabling the stopper support part to be retained in a given position relative to the attachment part, whereby, when the device is prepared for use, and the attachment part is fixedly attached to such an operator, the latter operates to move the device downwardly so that a lower end of a stopper mounted on the stopper support part engages the outlet of the apparatus, the said degree of movement enabling that end to be seated properly in the outlet, whereupon the locking means are used to retain the resulting position of the stopper support part relative to the attachment part to ensure that the stopper will be properly seated after subsequently being raised and lowered.

Preferably, the degree of movement permitted between the attachment part and the stopper support part is a pivotal movement. One possible means of enabling such pivotal movement comprises a universal joint between the stopper support part and the attachment part of the stopper device.

The locking means may comprise a generally spherical surface on one of those parts, and clamping means to urge a surface on the other of those parts against the generally spherical surface.

The generally spherical surface may for example be a concave surface on the stopper support part. In that case the centre of curvature of that spherical surface may be generally coincident with the pivot point of the universal joint.

The attachment part may comprise a clamp.

The present invention extends to a method of operating molten-metal auto-pouring apparatus using a stopper device made in accordance with the present invention.

An example of a stopper device made in accordance with the present invention will now be described with reference to the accompanying drawings, in which:

Figure 1:
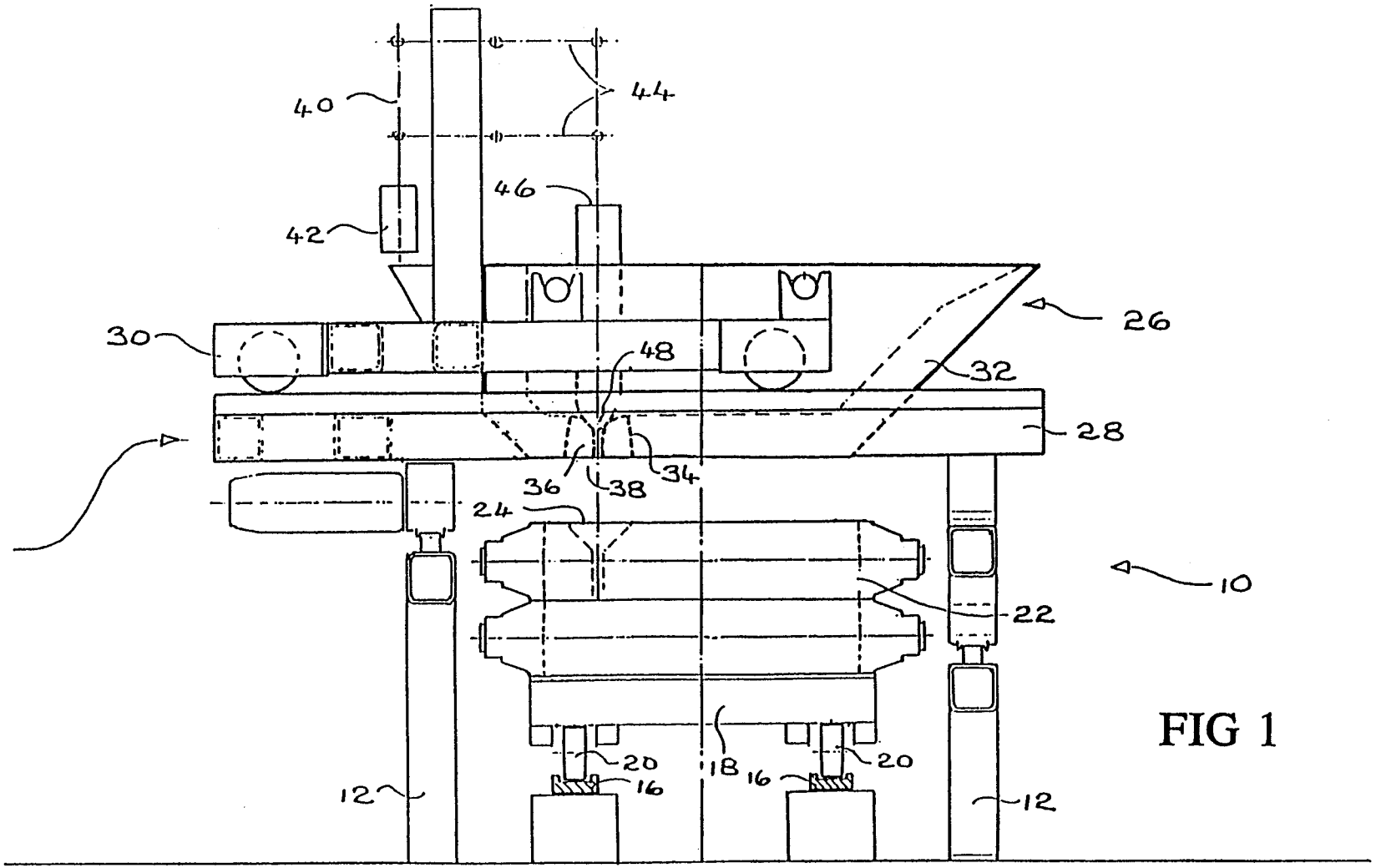
FIG. 1 shows a diagrammatical elevational sectional view of molten-metal auto-pouring apparatus incorporating such a stopper device.

Molten-metal auto-pouring apparatus 10 shown in FIG. 1 comprises stanchions 12 on which is supported a cradle assembly 14. A track 16 extends underneath the cradle assembly 14 and between the stanchions 12. Carriages 18 (only one of which is shown in FIG. 1) travel along the track 16, and are provided with wheel assemblies 20 which engage the track 16 for this purpose. The carriages 18 support sand-mould flasks 22 each of which is provided with at least one molten-metal inlet orifice 24.

The cradle assembly 14 supports a crucible assembly 26, and has a first cradle 28 constructed to enable the crucible assembly 26 to be moved in a longitudinal direction, relative to the track 16, and a second cradle 30 constructed to enable the crucible assembly to be moved transversely of the track 16.

The crucible assembly 26 comprises a crucible 32 for holding molten-metal. The crucible has an aperture 34 in its base wall which tapers in an upward direction, and receives a graphitised alumina outlet nozzle 36. The latter is held in place by a retainer device 38.

The cradle assembly 26 further comprises a stopper device operator 40 having a pneumatic drive 42 connected to operate a parallelogram linkage 44 to which is attached a stopper device 46. The latter has a graphite lower tip 48 which is rounded and which engages the convex curved internal sides of the outlet nozzle 36.

When the apparatus is in use, a carriage 18 is moved along the track 16 until the orifice 24 is directly beneath the outlet 36. The pneumatic drive 42 then operates the parallelogram linkage 44 to raise the stopper device 46. This creates a clearance between the tip 48 of the stopper device and the internal sides of the outlet nozzle, whereupon molten-metal within the crucible 32 pours into the sand mould within the flask 22 under the force of gravity. After a predetermined time interval, or after a detector (not shown) indicates that the sand mould within the flask 22 has been filled, the pneumatic drive 42 operates the parallelogram linkage 44 to lower the stopper device 46 so that its tip 48 is seated against the outlet nozzle 36 to prevent further outflow of molten-metal. The next carriage 18 in a train of such carriages (not shown) is then indexed along the track 16 until its orifice is directly beneath the crucible outlet 36, whereupon the process is repeated.

Figure 2:
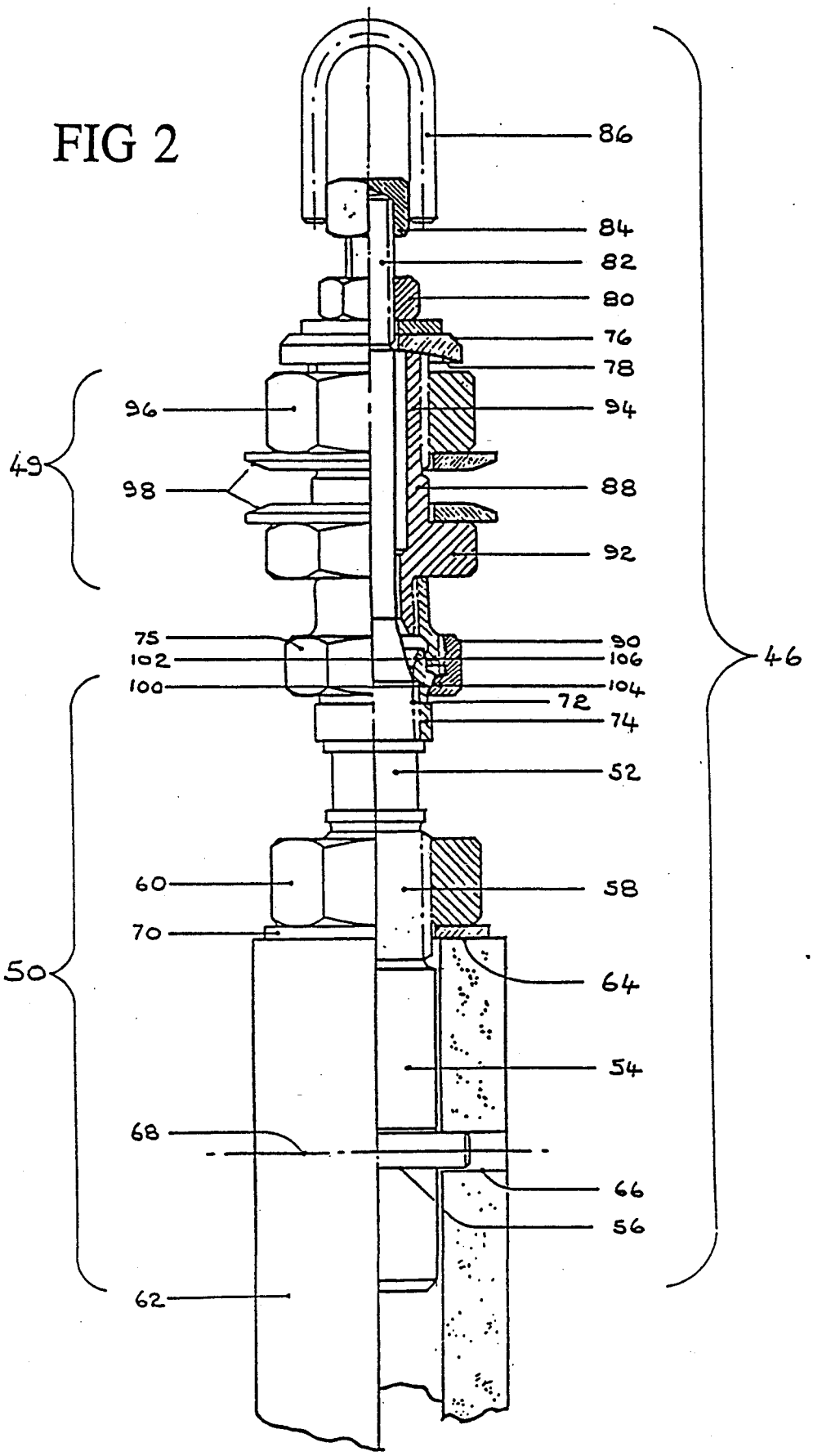
FIG. 2 shows a part side and part axial sectional vie w of the stopper device shown diagrammatically in FIG. 1.

The stopper device 46 is shown in greater detail in FIG. 2. It comprises an attachment part 49 and a stopper support part 50.

The stopper support part 50 comprises a stem 52 which, at its intended lower end has a generally cylindrical shaft 54 through which extends a transverse bore 56. Immediately above the cylindrical shaft portion 54 is an externally screw-threaded portion 58 of the stem 52 engaged by an internally screw-threaded nut 60. A hollow, generally cylindrical graphite stopper 62, having an internal diameter which slightly exceeds the external diameter of the cylindrical shaft portion 54, is open at an upper end 64 thereof, but closed its intended bottom end to provide the generally rounded tip 48 shown in FIG. 1. The stopper 62 is also provided with a transverse bore 66. In FIG. 2, the shaft portion 54 is inserted into the interior of the stopper 62 so that the transverse bores 56 and 66 are in registration with one another, and a pin 68 is inserted through the transverse bores to secure the stopper 62 on the stopper support part 50. The nut 60 has been rotated relative to the screw-threaded part 58 in a downward direction, to hold the top of the stopper 62 via a washer 70.

Above the screw-threaded part 58, the stem 52 is provided with a further external screw-threaded part 72 on to which is threaded an internal part 74 of a universal joint 75. The upper end of the stem 52 is provided with a locking flange 76 having a concave generally spherical surface 78 on its inside and which is urged downwardly by means of a nut 80 engaging a screw-threaded top shaft 82 of the stem 52. The centre of curvature of the surface 78 is generally coincident with the pivot point of the universal joint 75. A top nut 84 is made as a threaded cap. This is to ensure that it cannot be used as a locking nut for the nut 80. If it were so used, it could cause seizure between those nuts. The top nut 84 is used to hold a lifting ring 86.

The attachment part 49 comprises a sleeve 88 having an internal diameter significantly greater than the external diameter of that part of the stem 52 which it surrounds, to enable a fair degree of pivotal movement between the stem 52 and the sleeve 88 about the universal joint 75.

The lower end of the sleeve 88 is provided with an outer part 90 of the universal joint 75. Thus the sleeve 88 is pivotable relative to a point on the axis of the stem 52 by virtue of this universal joint. At a midway point along the stem 88 there is provided a shoulder portion 92 which has a hexagonal cross-section so that it constitutes a fixed nut on the stem 88. Spaced apart therefrom in an intended upward direction there is an externally screw-threaded portion 94 of the stem 88 which is engaged by an internally screw-threaded nut 96. Sandwiched between the two nuts 96 and 92 there are clamping flanges 98. These have bevelled edges on their mutually facing sides to facilitate more readily reception of a fork (not shown) secured to the parallelogram linkage 44 shown in FIG. 1. Once the fork is inserted, the nut 96 is rotated to clamp the fork firmly between the flanges 98, thereby releasably fixedly attaching the attachment part 49 to the parallelogram linkage 44.

It will be noted that the universal joint 75 is constituted by a lower external convex surface 100 and an upper external convex surface 102 on its inner part 74 slidably engaging a lower internal concave surface 104 and an upper internal concave surface 106 of its outer part 90 respectively. The outer part 90 may itself have two parts, providing the two concave surfaces of the joint respectively, which engage one another by means of a screw-threaded attachment to enable the universal joint to be locked in position at a given setting thereof.

When the stopper device is installed for use, with the fork (not shown) of the parallelogram linkage 44 clamped between the flanges 98 of the attachment part 49, and with the stopper support part 50 free to pivot relative to the attachment part 49 by means of the universal joint 75, the stopper device is lowered by the parallelogram linkage 44 towards the nozzle outlet 36 of the crucible 32 The tip end 48 engages the outlet nozzle 36 and, because of the freedom of movement between the attachment part 49 and the stopper support part 50, and because of the curvature of the tip 48 of the stopper and the internal surfaces of the outlet nozzle 36, the tip end moves laterally if necessary, with a resulting pivotal movement at the universal joint 75, until the tip end 48 forms a snug fit in the outlet nozzle 36. With that resulting relative positioning between the attachment part 49 and the stopper support part 50, provided by a give setting of the universal joint 75, the nut 80 is rotated relative to the screw-threaded part 82 to clamp the flange 78 against the upper end of the stem 88. The outer part 90 of the universal joint 75 may also be rotated relative to the fixed portion to tighten that joint 75. In this way the attachment part 49 is locked in position relative to the stopper support part 50, whereafter subsequent raising and lowering of the stopper device by the parallelogram linkage 44 will ensure a proper opening and closing of the outlet nozzle 36, without the stopper rotating axially.

The universal joint 75 may be freed during subsequent use of the auto-pouring apparatus 10, even when the crucible 32 has molten iron inside it, and the foregoing adjustment repeated, in the event that wear on the stopper 62 and/or the outlet nozzle 36 requires this.

Numerous variations and modifications to the stopper device illustrated in FIG. 2 will readily occur to the person familiar with the art without taking it outside the scope of the present invention. For example, the universal joint 74 can be replaced by two simple pivots arranged at right angles to one another to facilitate the desired pivotal movement between the attachment part 49 and the stopper support part 50.

I claim:

1. For use in molten-metal auto-pouring apparatus having an outlet and a stopper device operator:

a stopper device comprising (a) an attachment part;

(b) releasable attachment means of the attachment part whereby the attachment part is releasably fixedly attached to the operator;

(c) a stopper support part adjustably connected to the attachment part so as to permit a degree of movement therebetween;

(d) locking means on the attachment part and the stopper support part, which locking means serve to lock the stopper support part in a given position relative to the attachment part and thus to prevent subsequent movement therebetween;

whereby, when the device is prepared for use with a stopper mounted on the stopper support part and the attachment part fixedly attached to the operator, and the operator moves the device downwardly to bring the lower end of the stopper into engagement with the outlet, the said degree of movement enables that end to be seated properly in the outlet, whereafter the locking means are used to retain the resulting position of the stopper support part relative to the attachment part to ensure that the stopper will be properly seated subsequently after being raised and lowered, substantially without lateral movement of the stopper against the outlet, and whereby any re-alignment which is subsequently necessary between the stopper and the outlet is effected by releasing the locking means, lowering the device downwardly to bring the lower end of the stopper into engagement with the outlet, the said degree of movement once again enabling that end to be seated properly in the outlet, whereupon the locking means are used again to retain the resulting position of the stopper support part relative to the attachment part, without removing the stopper device from the operator and without replacing the stopper.

2. A device according to claim 1, in which connection means are provided between the attachment part and the stopper support part in which the said degree of movement permitted between the said parts is a pivotal movement.

3. A device according to claim 2, in which the connection means comprise a universal joint.

4. A device according to claim 1, in which the locking means comprise a generally spherical surface on one of the stopper support parts, and clamping means to urge a surface on the other of the stopper support parts against the generally spherical surface.

5. A device according to claim 4, in which the generally spherical surface is a concave surface on the stopper support part.

6. A device according to claim 4, in which the connection means comprise a universal joint and in which the center of curvature of the said generally spherical surface is generally coincident with the center of movement of the universal joint.

7. A device according to claim 1, in which the attachment part comprises a clamp.

8. Molten metal auto pouring apparatus comprising:

(a) a stopper device operator;

(b) an outlet;

(c) a stopper device;

(d) an attachment part of the stopper device;

(e) releasable attachment means of the attachment part whereby the attachment part is releasably fixedly attached to the operator;

(f) a stopper support part of the stopper device adjustably connected to the attachment part so as to permit a degree of movement therebetween;

(g) locking means on the attachment part and the stopper support part, which locking means serve to lock the stopper support part in a given position relative to the attachment part and thus to prevent subsequent movement therebetween;

(h) a stopper mounted on the stopper support part;

whereby when the apparatus is in use the operator moves the device downwardly to bring the lower end of the stopper into engagement with the outlet, the said degree of movement enabling that end to be seated properly in the outlet, whereafter the locking means are used to retain the resulting position of the stopper support part relative to the attachment part to ensure that the stopper will be properly seated subsequently after being raised and lowered, substantially without lateral movement of the stopper against the outlet, and whereby any re-alignment which is subsequently necessary between the stopper and the outlet is effected by releasing the locking means, lowering the device downwardly to bring the lower end of the stopper into engagement with the outlet, the said degree of movement again enabling that end to be seated properly in the outlet, whereupon the locking means are used again to retain the resulting position of the stopper support part relative to the attachment part, without removing the stopper device from the operator and without replacing the stopper.

9. A method of operating molten-metal auto-pouring apparatus as claimed in claim 8 comprising the steps of:

(a) moving the device downwardly to bring the lower end of the stopper into engagement with the outlet, the said degree of movement enabling the stopper support part to adopt a position relative to the attachment part in which that end is seated properly in the outlet;

(b) locking the stopper support part in that position by means of the locking means; and (c) raising and lowering the device to effect subsequent pouring of molten-metal while retaining that position of the stopper support part relative to the attachment part by means of the locking means.

* * * * *